US012134443B2

(12) United States Patent
Jo et al.

(10) Patent No.: US 12,134,443 B2
(45) Date of Patent: Nov. 5, 2024

(54) DROP ASSIST APPARATUS OF UNMANNED MARINE OBSERVATION APPARATUS AND CONTROLLING METHOD THEREOF

(71) Applicant: National Institute of Meteorological Sciences, Seogwipo-si (KR)

(72) Inventors: Hyeong Jun Jo, Jeju-si (KR); Kiryong Kang, Seogwipo-si (KR); Jaeil Lee, Seogwipo-si (KR); Chulkyu Lee, Seoul (KR); Byeongtaek Kim, Seogwipo-si (KR)

(73) Assignee: NATIONAL INSTITUTE OF METEOROLOGICAL SCIENCES, Seogwipo-si (KR)

( * ) Notice: Subject to any disclaimer, the term of this patent is extended or adjusted under 35 U.S.C. 154(b) by 0 days.

(21) Appl. No.: 18/319,465

(22) Filed: May 17, 2023

(65) Prior Publication Data

US 2024/0174327 A1 May 30, 2024

(30) Foreign Application Priority Data

Nov. 28, 2022 (KR) ..... 10-2022-0161986

(51) Int. Cl.
*B63B 23/02* (2006.01)

(52) U.S. Cl.
CPC ..... *B63B 23/02* (2013.01)

(58) Field of Classification Search
CPC ..... B63B 23/02; B63B 23/04; B63B 23/06; B63B 23/08; B63B 23/10; B63B 23/12; B63B 23/14; B63B 23/16; B63B 23/18
USPC ..... 114/50, 259, 268, 368, 369, 370, 372, 114/373, 374
See application file for complete search history.

(56) References Cited

U.S. PATENT DOCUMENTS

| | | | | |
|---|---|---|---|---|
| 4,442,786 | A * | 4/1984 | Conners | B63B 35/14 43/14 |
| 6,516,737 | B2 * | 2/2003 | Le Coz | B63B 25/004 114/72 |
| 10,315,732 | B2 * | 6/2019 | Wallin | B63B 27/30 |

FOREIGN PATENT DOCUMENTS

| | | | |
|---|---|---|---|
| JP | 2018165090 | A | 10/2018 |
| KR | 100814832 | B1 | 3/2008 |
| KR | 20140115718 | A | 10/2014 |
| KR | 101665313 | | 10/2016 |
| KR | 101908914 | B1 | 10/2018 |
| KR | 102020149 | B1 | 9/2019 |

* cited by examiner

*Primary Examiner* — Daniel V Venne
(74) *Attorney, Agent, or Firm* — CANTOR COLBURN LLP

(57) ABSTRACT

Provided is an apparatus for assisting in dropping an unmanned marine observation device, the apparatus including a support part installed on a ship, a column part installed to be movable in a horizontal direction relative to the support part, a first link member having the other end linked to an upper side of the column part, a second link member having the other end linked to one end of the link member, and a holding unit installed on the second link member so as to be movable in a longitudinal direction of the second link member, in which the holding unit is configured to hold an outer periphery of the unmanned marine observation device.

3 Claims, 7 Drawing Sheets

DROP ASSIST APPARATUS OF UNMANNED MARINE OBSERVATION APPARATUS AND CONTROLLING METHOD THEREOF

BACKGROUND

Field

The present application relates to an apparatus for assisting in dropping an unmanned marine observation device and a method of controlling the same. More specifically, the present application relates to an apparatus for assisting in dropping an unmanned marine observation device, which is used to drop the unmanned marine observation device, and a method of controlling the same.

Description of the Related Art

Because marine observation causes great difficulty and enormous costs in comparison with atmospheric observation, the amount of marine observation data is very insufficient compared to the amount of atmospheric observation data. With the development of remote observation using artificial satellites, a lack of marine observation has been greatly solved accordingly. However, because the marine observation is limited to the surface layer, there is still a limitation in recognizing the internal structure of the ocean.

Therefore, the World Meteorological Organization (WMO) and the Intergovernmental Oceanographic Commission (IOC) jointly organized the international joint research program for ARGO (array for real-time geostrophic oceanography), which is a project for establishing a marine observation network throughout the earth. An ARGO float refers to an unmanned automatic observation device that automatically and vertically observes the ocean in accordance with preset cycles and preset depths. The ARGO float generally observes a location of up to 2,000 m every ten days.

In addition, the National Institute of Meteorological Sciences of the Korea Meteorological Administration also participated in the joint research program in 2001 at the initial time of the joint research program and dropped a total of 259 ARGO floats so far on the coast of the Korean Peninsula around the East Sea and the Northwest Pacific. Further, the National Institute of Meteorological Sciences has processed data and managed quality while managing local data centers, and thus plays a pivotal role in the sea area of East Asia.

The ARGO floats are mainly dropped on the coast of the Korean Peninsula and the Northwest Pacific by using merchant ships and meteorological observatory ships of the Korea Meteorological Administration, and operators directly and manually drop the ARGO floats in the ocean without particular equipment.

For this reason, because the dropping operator directly drops the ARGO float, it is difficult to ensure safety in the ocean, and there often occurs a situation in which the safety of a dropping operator is threatened by risk factors such as high waves and strong wind.

Furthermore, there are lots of concerns about damage to equipment and hulls. Accordingly, the present technology has been developed to ensure safety and minimize damage to the equipment and the hulls in a dropping situation.

The background art of the present application is disclosed in Korean Patent No. 10-1665313.

SUMMARY

An object to be achieved by the present disclosure is to provide an apparatus for assisting in dropping an unmanned marine observation device, which minimizes damage to an equipment main body and a hull on which a dropping operation is performed.

Further, another object to be achieved by the present disclosure is to ensure safety of a dropping operator at the time of dropping an unmanned marine observation device.

Further, still another object to be achieved by the present disclosure is to ensure safety against risk factors high waves and strong wind when a dropping operator drops an unmanned marine observation device.

However, technical problems to be solved by the exemplary embodiment of the present application are not limited to the aforementioned technical problem, and other technical problems may be present.

According to an aspect of the present disclosure, there is provided an apparatus for assisting in dropping an unmanned marine observation device, the apparatus including: a support part installed on a ship: a column part installed to be movable in a horizontal direction relative to the support part: a first link member having one end linked to an upper side of the column part: a second link member having one end linked to the other end of the first link member; and a holding unit installed on the second link member so as to be movable in a longitudinal direction of the second link member, in which the holding unit is configured to hold an outer periphery of the unmanned marine observation device.

According to the embodiment of the present specification, the support part may include a rail part coupled to a lower side of the column part by means of a rail so that the column part is movable in the horizontal direction, and the rail part may be provided to allow the column part to move along the rail part so that the second link member is selectively positioned at any one of inner and outer sides of the ship.

According to the embodiment of the present specification, the holding unit may be rotatable about a rotation axis perpendicular to the longitudinal direction of the second link member.

According to the embodiment of the present specification, the column part may be extendable and contractible in an upward/downward direction.

According to another aspect of the present disclosure, there is provided a system for ascertaining in dropping an unmanned marine observation device, the system including a power source part configured to supply power for operating the apparatus for assisting in dropping an unmanned marine observation device.

According to the embodiment of the present specification, the system may include an operation part configured to control the apparatus for assisting in dropping an unmanned marine observation device.

According to still another aspect of the present disclosure, there is provided a method of controlling the apparatus for assisting in dropping an unmanned marine observation device using the system for assisting in dropping an unmanned marine observation device, the method including: step (a) of receiving, by the operation part, a user input; and step (b) of transmitting a signal, which corresponds to the user input, to the unmanned marine observation device apparatus for assisting in dropping and performing an operation corresponding to the user input.

According to the embodiment of the present specification, steps (a) and (b) may be repeatedly performed in accordance with the number of times of the user input.

The technical solution is just illustrative but should not be interpreted as being intended to limit the present application. In addition to the above-mentioned exemplary embodiment, additional exemplary embodiments may be present in the drawings and the detailed description of the present disclosure.

The technical solution of the present application provides the apparatus for assisting in dropping the unmanned marine observation device, which makes it possible to minimize damage to the equipment main body and the hull on which the dropping process is performed.

According to the technical solution of the present application, it is possible to ensure the safety of the dropping operator at the time of dropping the unmanned marine observation device.

According to the technical solution of the present application, it is possible to ensure the safety against risk factors caused by high waves and strong wind when the dropping operator drops the unmanned marine observation device.

According to the technical solution of the present application, it is possible to adjust the dropping angle at the time of dropping the unmanned marine observation device, which makes it possible to prevent the unmanned marine observation device from being introduced into the vicinity of a lower scroll of a ship after the unmanned marine observation device is dropped.

However, the effects, which can be obtained by the present application, are not limited to the above-mentioned effects, and other effects may be present.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
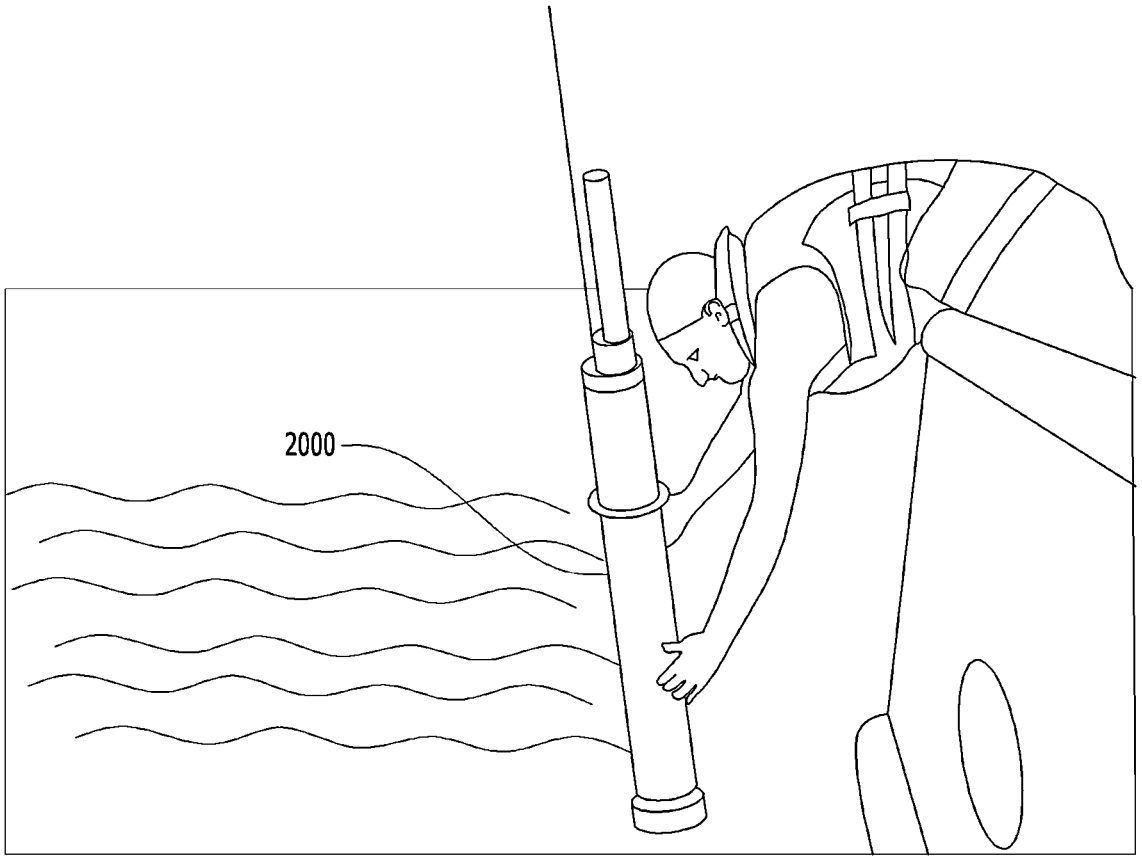
FIG. 1 is a photograph illustrating a situation in which a dropping operator directly drops an unmanned marine observation device.

Hereinafter, embodiments of the present application will be described in detail with reference to the accompanying drawings so that those with ordinary skill in the art to which the present application pertains may easily carry out the embodiments. However, the present application may be implemented in various different ways, and is not limited to the embodiments described herein. A part irrelevant to the description will be omitted in the drawings in order to clearly describe the present application, and similar constituent elements will be designated by similar reference numerals throughout the specification.

Throughout the specification of the present application, when one constituent element is referred to as being "connected to" another constituent element, one constituent element can be "directly connected to" the other constituent element, and one constituent element can also be "electrically connected to" or "indirectly connected to" the other element with other elements therebetween.

Throughout the specification of the present application, when one member is disposed "on", "at an upper side of", "at an upper end of", "below", "at a lower side of", or "at a lower end of" another member in the present specification of the present application, this includes not only a case where one member is brought into contact with another member, but also a case where still another member is present between the two members.

Throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

Words of degree, such as "about", "substantially", and the like are used throughout the specification of the present application in the sense of "at, or nearly at, when given the manufacturing, design, and material tolerances inherent in the stated circumstances" and are used to prevent the unscrupulous infringer from unfairly taking advantage of the present disclosure where exact or absolute figures and operational or structural relationships are stated as an aid to understanding the present disclosure. Throughout the specification of the present application, the term "step . . . " or "step of . . . " does not mean "step for . . . ".

In the present specification, the term 'unit,' 'part,' or 'means' includes a unit realized by hardware, a unit realized by software, and a unit realized by using both software and hardware. In addition, one unit may be realized by using two or more hardware, and two or more units may be realized by using one hardware.

In the present specification, some of the operations or functions, which are described as being performed by a terminal, an apparatus, or a device, may be instead performed by a server connected to the terminal, the apparatus, or the device. Likewise, some of the operations or functions, which are described as being performed by a server, may be performed by a terminal, an apparatus, or a device that is connected to the server. Hereinafter, an embodiment of the present disclosure will be described in detail with reference to the accompanying drawings.

According to the embodiment of the present application, FIG. 1 is a photograph illustrating a state in which an unmanned marine observation device 2000 is dropped in the related art.

Referring to FIG. 1, because a dropping operator directly and manually drops the equipment in the ocean without using particular equipment, it is difficult to ensure safety in the ocean, and there occurs a situation in which safety of the dropping operator is threatened by risk factors such as high waves and strong wind. In addition, there is also concern that the equipment and hull are damaged in a dropping situation.

Figure 2:
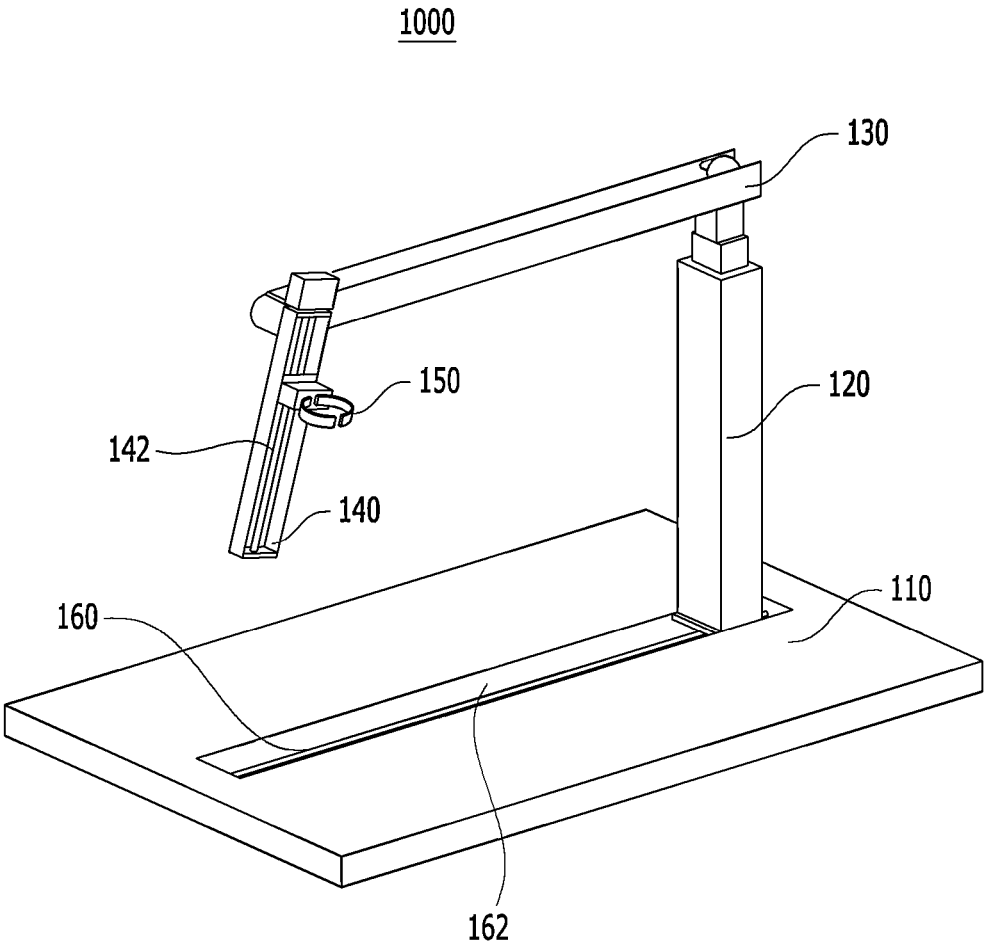
FIG. 2 is a view illustrating a configuration of an apparatus for assisting in dropping an unmanned marine observation device according to an embodiment of the present application.

FIG. 2 is a view illustrating a configuration of an apparatus 1000 for assisting in dropping an unmanned marine observation device according to an embodiment of the present application.

In addition, referring to FIG. 2, the apparatus 1000 for assisting in dropping an unmanned marine observation device may be used to solve the problem in the related art, such that it is possible to ensure safety against a safety accident occurring in the dropping situation and to minimize damage to the equipment and the hull.

In addition, the apparatus 1000 for assisting in dropping an unmanned marine observation device may be manufactured to be installed on a ship and include a power source part 170 configured to supply power, and an operation part 180 configured to operate the equipment. The apparatus 1000 may have a structure of a main body that fixes the equipment on a floor and automatically drops the unmanned marine observation device.

In addition, the apparatus 1000 for assisting in dropping an unmanned marine observation device may include a support part 110, a column part 120, a first link member 130, a second link member 140, a holding unit 150, and a rail part 160 which are installed on the ship. However, the present disclosure is not limited thereto. The apparatus 1000 for assisting in dropping an unmanned marine observation device may further include additional components.

In addition, the apparatus 1000 for assisting in dropping an unmanned marine observation device may be coupled and fixed to a middle portion of the ship in consideration of a center of gravity of the unmanned marine observation device 2000 and set a dropping direction by 360 degrees.

In addition, because a height of the ship from a seawater surface varies, the column part is configured to perform a height adjustment function. At a lower end of the column part, a rail 162 is provided to enable the column part to horizontally move to maintain a safety distance from a guardrail of the ship, and a support is provided to support the entire apparatus 1000 for assisting in dropping an unmanned marine observation device.

In addition, FIG. 1 is a view illustrating a configuration of the apparatus 1000 for assisting in dropping an unmanned marine observation device. The dropping process may be performed while appropriately adjusting angles and dimensions of the column part 120, the first link member 130, the second link member 140, and the rail part 160 in accordance with the situation.

According to the embodiment of the present application, the apparatus 1000 for assisting in dropping an unmanned marine observation device may include: the support part 110 installed on the ship: the column part 120 installed to be movable in a horizontal direction relative to the support part 110: the first link member 130 having one end linked to an upper side of the column part 120; the second link member 140 having one end linked to the other end of the first link member; and the holding unit 150 installed on the second link member 140 so as to be movable in a longitudinal direction of the second link member 140. The holding unit 150 may hold an outer periphery of the unmanned marine observation device 2000.

In addition, the unmanned marine observation device 2000 may be, but not limited only to, an ARGO float. The unmanned marine observation device may be understood as a wide concept including other unmanned devices in the related art or various devices to be developed in the future.

The support part 110 of the apparatus 1000 for assisting in dropping an unmanned marine observation device according to the embodiment of the present application may include the rail part 160 coupled to a lower side of the column part 120 by means of a rail 162 formed in the rail part 161 so that the column part 120 may move in the horizontal direction.

In addition, the plurality of unmanned marine observation devices 2000 may be provided at an upper side of the support part 110.

In addition, the plurality of unmanned marine observation devices 2000 stacked at the upper side of the support part 110 may be fixed to be prevented from being collapsed by vibration, high waves, and strong wind, thereby preventing a safety accident.

In addition, the support part 110 may include the rail provided to maintain a safety distance from the guardrail of the ship.

Further, the support part 110 may move along the rail, such that the support part 110 may move so that a user may be positioned at a desired point on a deck of the ship.

In addition, the support part 110 may be installed on the deck of the ship.

In addition, the rail, which is formed in the form of a guide slot formed in the support part 110, may have various shapes to securely couple auxiliary devices.

Further, the support part 110 may have a plurality of rails made by adding additional slots to the rail. The support part 110 may be provided to support the auxiliary devices.

In addition, the support part 110 may have a structure having a height that is adjustable to drop the unmanned marine observation device 2000 from the ship having a variable height.

Figure 3:
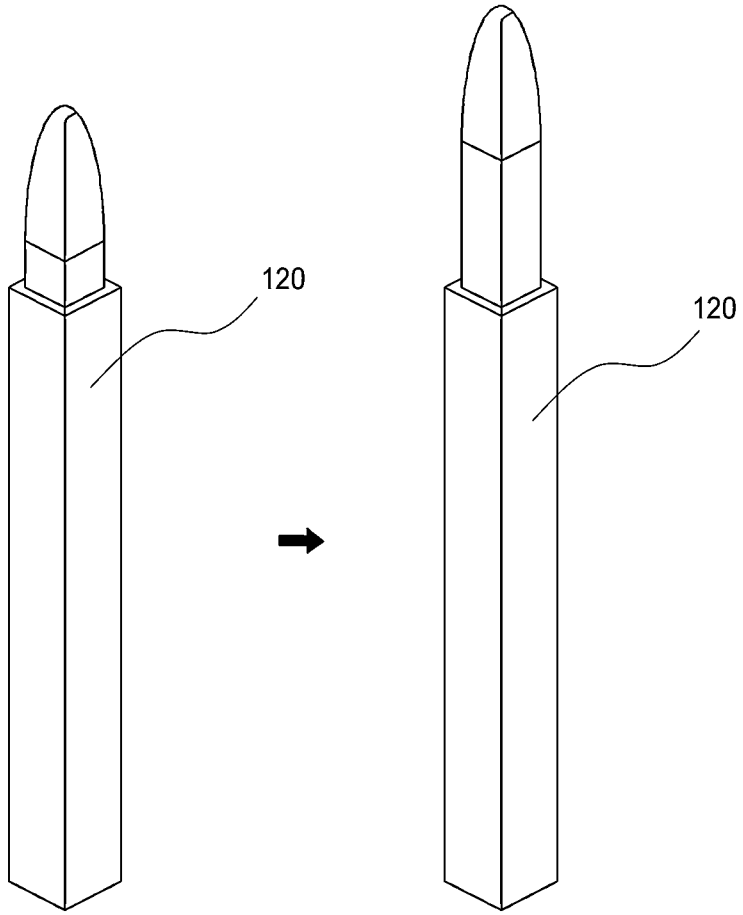
FIG. 3 is a view for explaining a column part according to the embodiment of the present application.

Referring to FIG. 3, the column part 120 is provided to be extendable and contractible in an upward/downward direction.

In addition, the column part 120 may include: a first column connected to the support part 110 (connected to the rail part 160 of the support part 110) and having a first column hollow portion; and a second column configured to be movable in the upward/downward direction in a state in which the second column is partially inserted into the first column hollow portion.

With this configuration, the column part 120 may have a structure that is extendable, like a radio antenna. In addition, the present disclosure is not limited to the first column and the second column, but a third column or the like may be added. Further, like the first column, the second column may also have a second column hollow portion.

In addition, at the time of dropping the unmanned marine observation device 2000, the column part 120 is extended or contracted, which makes it possible to prevent the guardrail of the ship from being damaged.

In addition, the column part 120 may be formed to be inclined at a predetermined angle or more to drop the unmanned marine observation device 2000.

In addition, the upper side of the column part 120 may be coupled to the first link member 130. The column part 120 may have various coupling structures.

For example, the upper side of the column part 120 includes the hollow portion, such that the first link member 130 may be coupled to the hollow portion of the column part 120.

Figure 4:
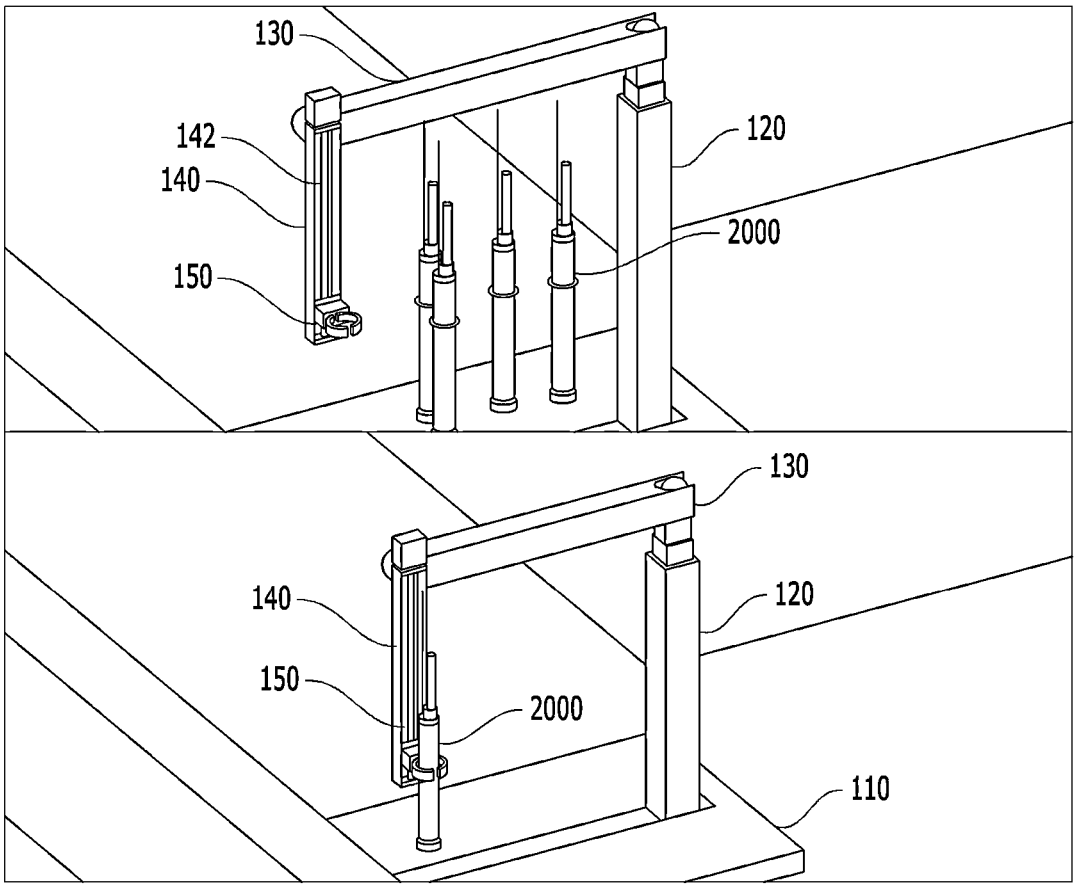
FIG. 4 is a view illustrating a state in which an unmanned marine observation device is prepared to be dropped by the apparatus for assisting in dropping an unmanned marine observation device according to the embodiment of the present application.

FIG. 4 is a view illustrating a state in which an unmanned marine observation device is prepared to be dropped by the apparatus 1000 for assisting in dropping an unmanned marine observation device according to the embodiment of the present application.

Referring to FIG. 4, the other end of the first link member 130 may be linked to the upper side of the column part 120.

The first link member 130 may be coupled to the upper side of the column part 120 in various ways. For example, the coupling methods may include, but not limited only to, various methods such as link coupling, coupling using bolts and nuts, coupling using magnets, and press-fitting using a hole formed through the upper side of the column part 120.

In addition, an angle of the first link member 130 may be adjusted. For example, the angle may be at least one of a rotation axis or a rotation angle between the column part 120 and the first link member 130 and a rotation axis or a rotation angle between the first link member 130 and the second link member 140.

Referring to FIG. 4, the other end of the second link member 140 may be linked to one end of the first link member 130.

In addition, the second link member 140 may have a rail 142 coupled to the holding unit 150 so that the second link member 140 may move in the longitudinal direction.

In addition, various methods of coupling the second link member 140 may be applied. For example, the coupling methods may include at least one of link coupling, coupling using bolts and nuts, coupling using magnets, and press-fitting using a hold formed through one end of the second link member 140.

In addition, an angle of the second link member 140 may be adjusted during the dropping process. For example, the angle may be at least one of a rotation axis and a rotation angle between the first link member 130 and the second link member 140.

In addition, the second link member 140 may be selectively positioned at any one of inner and outer sides of the first link member 130.

Figure 5:
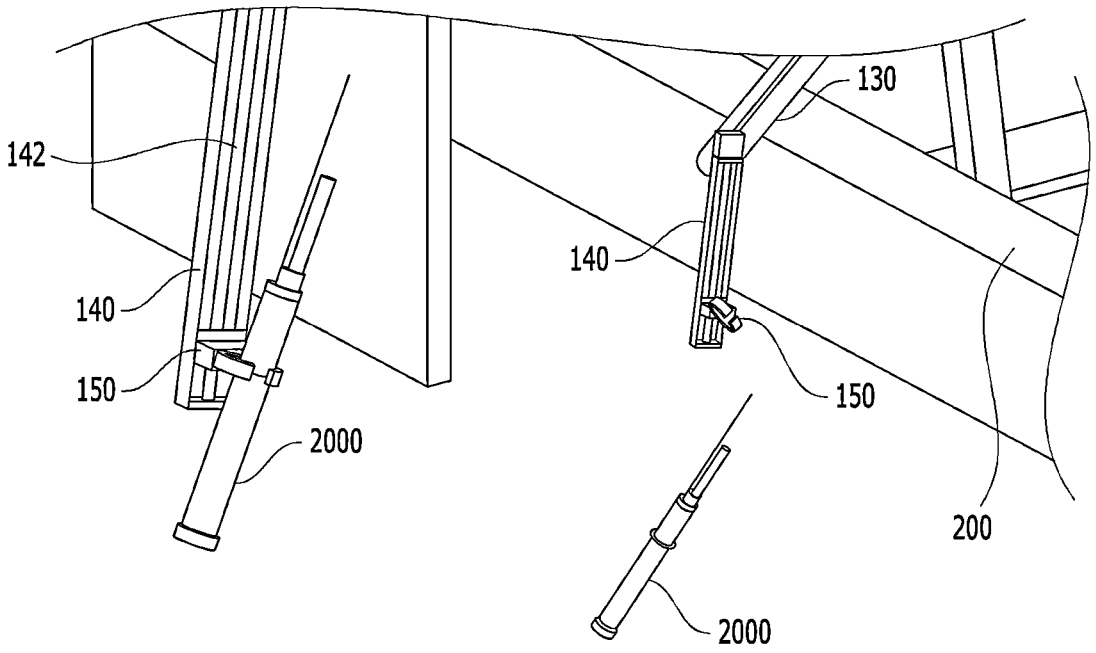
FIG. 5 is a view illustrating a process of dropping the unmanned marine observation device by using the apparatus for assisting in dropping an unmanned marine observation device according to the embodiment of the present application.

FIG. 5 is a view illustrating a process of dropping the unmanned marine observation device by using the apparatus 1000 for assisting in dropping an unmanned marine observation device according to the embodiment of the present application.

Referring to FIG. 5, the holding unit 150 may be provided to be rotatable about an axis perpendicular to the longitudinal direction of the second link member 140.

Referring to FIG. 5, the holding unit 150 may rotate and move in the longitudinal direction of the second link member 140. Therefore, when the unmanned marine observation device 2000 passes over the guardrail 200 of the ship, the angle of the holding unit 150 may be adjusted, such that the unmanned marine observation device 2000 may be dropped without being caught by the guardrail 200 of the ship.

In addition, the rotation of the holding unit 150 may prevent interference with the guardrail 200 of the ship, which makes it possible to prevent damage to the guardrail 200 of the ship and the unmanned marine observation device 2000.

In addition, the unmanned marine observation device 2000 may be automatically held by moving the column part 120, the first link member 130, and the second link member 140 and adjusting the angles of the column part 120, the first link member 130, and the second link member 140.

It is possible to prevent the hull and the unmanned marine observation device 2000 from being damaged during the dropping process by moving the second link member 140 of the holding unit 150 in the longitudinal direction and adjusting the angle of the second link member 140.

In addition, the holding unit 150 may hold the unmanned marine observation device 2000 regardless of the type or size of the unmanned marine observation device 2000.

In addition, during the process of dropping the unmanned marine observation device 2000, the holding unit 150 may drop the unmanned marine observation device 2000 while performing the longitudinal movement, the rotation, and the angle adjustment without changing the position or posture of the unmanned marine observation device 2000.

Figure 6:
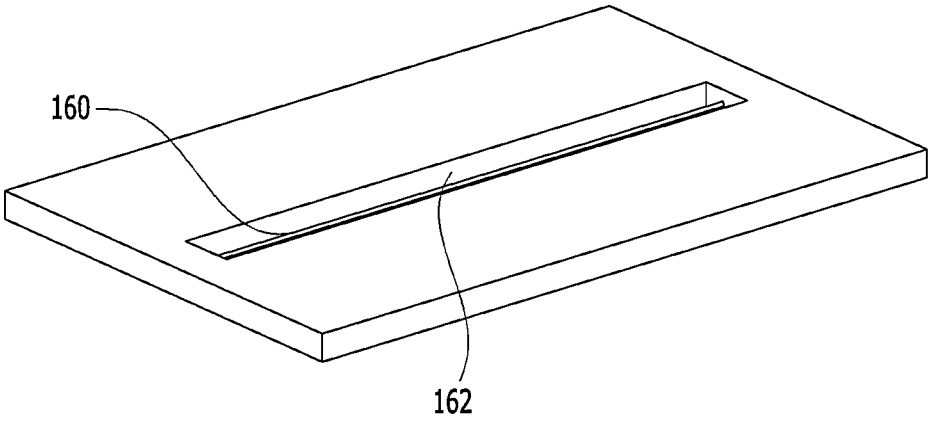
FIG. 6 is a view schematically illustrating a rail part according to the embodiment of the present application.

FIG. 6 is a view schematically illustrating the rail part 160 according to the embodiment of the present application.

Referring to FIG. 6, the rail part 160 may be provided to allow the column part 120 to move along the rail part 160 so that the second link member 140 may be selectively positioned at any one of the inner and outer sides of the ship.

According to the embodiment of the present application, the rail part 160 may be recessed and define a route elongated in the horizontal direction. In addition, the rail part 160 may be provided in the form of an extending guide slot 162.

In this case, the rail part 160 may be coupled to (engage with) the guide slot 162 by means of a rail so that the lower side of the column part 120 may move in advance along the guide slot 162.

In addition, with the structure in which the column part 120 may move along the rail part 160, the user may move the unmanned marine observation device 2000 to a desired dropping point and then drop the unmanned marine observation device 2000.

In addition, the rail part 160 may enable the column part 120 to move, and the rail may have various trajectories.

For example, the rail part 160 may not only enable the column part 120 to move along a horizontal trajectory but also enable the column part 120 to move along at least one of a circular trajectory and a curved line trajectory.

In addition, the rail, which constitutes the rail part 160, may have various structures. For example, the rail may have various structures including, but not limited to, a linear guide rail, a dual axis guide rail, a slide guide rail, and the like.

In addition, the rail part 160 may be operated to be movable in the longitudinal direction by the operation part 180. However, in addition, the rail part 160 may be manually moved in the longitudinal direction.

Figure 7:
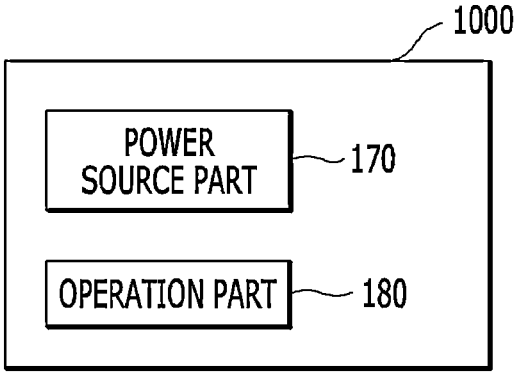
FIG. 7 is a view schematically illustrating a power source part and an operation part that control the apparatus for assisting in dropping an unmanned marine observation device according to the embodiment of the present application.

FIG. 7 according to the embodiment of the present application is a view schematically illustrating the power source part 170 and the operation part 180 that control the apparatus 1000 for assisting in dropping an unmanned marine observation device.

Referring to FIG. 7, the apparatus 1000 for assisting in dropping an unmanned marine observation device, which is a system for assisting in dropping an unmanned marine observation device, may include the power source part 170 configured to supply power for the operation.

In addition, because the unmanned marine observation device 2000 is automatically dropped, the power source part 170 needs to provide power for moving the unmanned marine observation device 2000. A 220V power code, which may be commonly used in the ship, may be connected, and then a power button may be pushed, such that power may be supplied to the device, and the device is prepared to be dropped.

In addition, the code for supplying power by the power source part 170 is not limited to the 220V power code. All the power codes, which may be used in the ship, may be configured to supply power.

In addition, the power source part 170 may be provided in a state such as a battery that may not only supply power, which is received from the power code, to the other devices to drop the unmanned marine observation device 2000 but also store power. In case that it is difficult to supply power from the user because of an external environment, the stored power may be supplied to the other devices on the basis of remote control.

In addition, referring to FIG. 7, the operation part 180 may be provided to control the apparatus 1000 for assisting in dropping an unmanned marine observation device.

The operation part 180 may set the position to drop the unmanned marine observation device 2000 on a position desired by the user.

In addition, the operation part 180 may set a desired angle, a waiting time, and the like in response to the user's input.

For example, the angle may be at least one of a rotation axis or a rotation angle between the column part 120 and the first link member 130, a rotation axis or a rotation angle between the first link member 130 and the second link member 140, and a rotation axis or a rotation angle between the second link member 140 and the holding unit 150.

In addition, the operation part 180 may incline the equipment at a predetermined angle or more to prevent damage to the hull at the time of dropping the equipment. The operation part 180 may determine whether a dropping point is reached and set the waiting time from several tens of seconds to several tens of minutes after the operation.

Further, the dropping waiting time may change the preset waiting time in accordance with the user's need.

In addition, the operation part 180 may operate to move the column part 120 along the rail to automatically hold the unmanned marine observation device 2000.

In addition, the operation part 180 may remotely control the apparatus 1000 for assisting in dropping an unmanned marine observation device to minimize the occurrence of the user's safety accident caused by high waves and strong wind. For example, the operation part 180 may remotely control the movement of the column part 120 and move the column part 120 to a point at which the unmanned marine observation device needs to be dropped. The operation part 180 may adjust the angle of the second link member 140 and control the longitudinal movement of the holding unit 150.

For example, the remote control method of the operation part 180 may be implemented in the form of program commands executable by means of various computer means and then written in a computer-readable recording medium. The computer-readable medium may include program instructions, data files, data structures, or the like, in a stand-alone form or in a combination thereof. The program instructions recorded in the medium may be specially designed and configured for the present disclosure or may be known and available to those skilled in computer software. Examples of the computer-readable recording medium may include magnetic media such as a hard disk, a floppy disk, and a magnetic tape, magneto-optical media such as a CD-ROM and a DVD, and hardware devices such as a ROM, a RAM, and a flash memory, which are specifically configured to store and execute program instructions. Examples of the program instructions may include machine codes made by, for example, a compiler, as well as high-language codes that may be executed by an electronic data processing device, for example, a computer, by using an interpreter. The above-mentioned hardware devices may be configured to operate as one or more software modules in order to perform the operation of the present disclosure, and the opposite is also possible.

In addition, the remote control of the operation part 180 may prevent a safety accident that may occur in weather such as bad weather.

Figure 8:
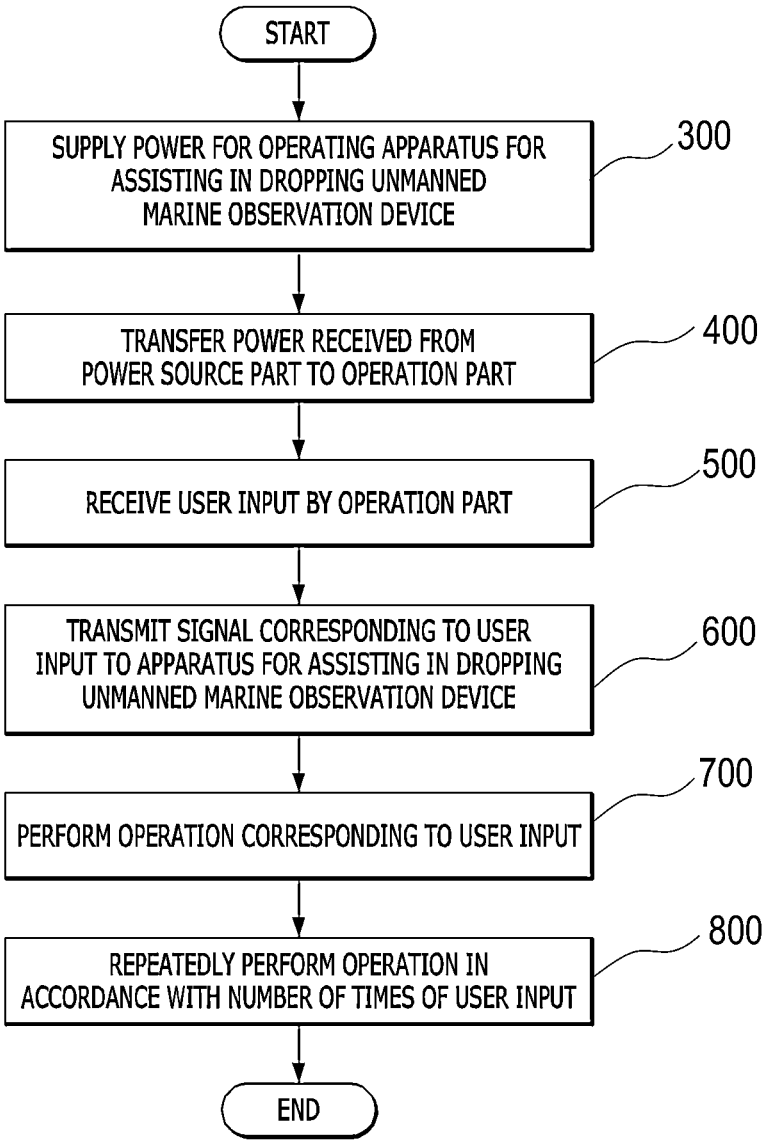
FIG. 8 is a view illustrating control steps using the apparatus or system for assisting in dropping an unmanned marine observation device according to the embodiment of the present application.

FIG. 8 according to the embodiment of the present application is a view illustrating control steps using the apparatus or system for assisting in dropping an unmanned marine observation device according to the embodiment of the present application.

Referring to FIG. 8, the control method of the apparatus 1000 for assisting in dropping an unmanned marine observation device using the dropping assisting system may include: step (a) of receiving, by the operation part 180, a user input; and step (b) of transmitting a signal, which corresponds to the user input, to the apparatus 1000 for assisting in dropping an unmanned marine observation device and performing an operation corresponding to the user input.

In addition, steps (a) and (b) may be repeatedly performed by the operation part 180 in accordance with the number of times of the user input.

However, FIG. 8 is just an example for assisting in understanding the present application, and the present disclosure is not limited thereto. The control method may further include additional steps and various constituent elements. As illustrated in FIG. 8, the control method may include: a step 300 of supplying power for assisting in dropping the unmanned marine observation device: a step 400 of transferring the power received from a power source part to the operation part: a step 500 of receiving user input by the operation part: a step 600 of transmitting a signal corresponding to the user input to the apparatus for assigning in dropping the unmanned marine observation device: a step 700 of performing operation corresponding to the user input; and a step 800 of repeatedly performing the operation in accordance with a number of times of the user input.

It will be appreciated that the embodiments of the present application have been described above for purposes of illustration, and those skilled in the art may understand that the present application may be easily modified in other specific forms without changing the technical spirit or the essential features of the present application. Therefore, it should be understood that the above-described embodiments are illustrative in all aspects and do not limit the present disclosure. For example, each component described as a single type may be carried out in a distributed manner. Likewise, components described as a distributed type can be carried out in a combined type.

The scope of the present application is represented by the claims to be described below rather than the detailed description, and it should be interpreted that the meaning and scope of the claims and all the changes or modified forms derived from the equivalent concepts thereto fall within the scope of the present application.

What is claimed is:

1. An apparatus for assisting in dropping an unmanned marine observation device, the apparatus comprising:

a support part installed on a ship;

a column part installed to be movable in a horizontal direction relative to the support part;

a first link member having one end linked to an upper side of the column part;

a second link member having an end linked an other end of the first link member; and a holding unit installed on the second link member by a first rail formed in the second link member so as to be movable in a longitudinal direction of the second link member and be rotatable about a rotation axis perpendicular to the longitudinal direction of the second link member, wherein the holding unit is configured to hold an outer periphery of the unmanned marine observation device, and be provided to be adjustable to prevent interference with a guardrail of the ship when the unmanned marine observation device held by the holding unit passes over the guardrail of the ship by rail movement and rotation with respect to the second link member and to prevent a position or a posture of the unmanned marine observation device from changing, wherein the support part comprises a rail part coupled to a lower side of the column part by a second rail formed in the rail part so that the column part is movable in the horizontal direction, wherein the rail part is provided to allow the column part to move along the rail part so that the second link member is selectively positioned at any one of inner and outer sides of the ship, and maintain a safety distance from the guardrail when the second link member is positioned at an inner side of the ship, and wherein the column part is extendable and contractible in an upward/downward direction in consideration of height adjustment for dropping the unmanned marine observation device from the height of the ship having a variable height and height adjustment to prevent the guardrail of the ship from being damaged.

2. A system for ascertaining in dropping an unmanned marine observation device, the system comprising:

the apparatus for assisting in dropping an unmanned marine observation device according to claim 1;

a power source part configured to supply power for operating the apparatus for assisting in dropping an unmanned marine observation device; and an operation part configured to control the apparatus for assisting in dropping an unmanned marine observation device.

3. A method of controlling the apparatus for assisting in dropping an unmanned marine observation device using a system for assisting in dropping an unmanned marine observation device according to claim 2, the method comprising:

step (a) of receiving, by the operation part, a user input; and step (b) of transmitting a signal, which corresponds to the user input, to the unmanned marine observation device apparatus for assisting in dropping and performing an operation corresponding to the user input, wherein steps (a) and (b) are repeatedly performed in accordance with the user input.

* * * * *